US009771718B1

(12) United States Patent
Curtin et al.

(10) Patent No.: US 9,771,718 B1
(45) Date of Patent: Sep. 26, 2017

(54) STRUT WITH NON-STRUCTURAL INFILL

(71) Applicant: TATE ACCESS FLOORS LEASING, INC., Wilmington, DE (US)

(72) Inventors: Daniel J. Curtin, Alexandria, VA (US); Peter R. Strapp, Silver Spring, MD (US); William W. Reynolds, Pasadena, MD (US); Daniel B. Kennedy, Lovettsville, VA (US)

(73) Assignee: TATE ACCESS FLOORS LEASING, INC., Wilmington, DE (US)

( * ) Notice: Subject to any disclaimer, the term of this patent is extended or adjusted under 35 U.S.C. 154(b) by 0 days.

(21) Appl. No.: 15/288,551

(22) Filed: Oct. 7, 2016

(51) Int. Cl.
*E04B 9/06* (2006.01)
*E04B 9/12* (2006.01)

(52) U.S. Cl.
CPC ..... *E04B 9/067* (2013.01); *E04B 9/12* (2013.01)

(58) Field of Classification Search
CPC . E04B 9/067; E04B 9/12; E04B 9/068; E04B 2001/2409; E04B 1/40; E04B 2001/405; E04F 13/0816; E04F 13/0846; E04F 13/0898; E04F 13/0875
See application file for complete search history.

(56) References Cited

U.S. PATENT DOCUMENTS 3,035,669 A * 5/1962 Graff ..... E04B 2/7854 52/241
3,327,438 A 6/1967 Cooper
3,685,235 A 8/1972 Lang
3,800,489 A * 4/1974 Boice ..... E04B 2/62 52/208
3,841,049 A * 10/1974 Boice ..... E04B 2/62 52/745.15
3,899,259 A * 8/1975 Boice ..... E04B 2/62 403/169
4,114,341 A * 9/1978 Vincens ..... E04B 1/24 52/580
4,257,205 A 3/1981 Kuhr
4,317,318 A 3/1982 Sauer
4,492,066 A * 1/1985 LaLonde ..... E04B 9/127 52/506.06

(Continued)

FOREIGN PATENT DOCUMENTS

EP 0 475 721 A1 3/1992
MY WO 2006070280 A1 * 7/2006 ..... B32B 3/04

*Primary Examiner* — Rodney Mintz
(74) *Attorney, Agent, or Firm* — Oliff PLC

(57) ABSTRACT

An elongated structural ceiling grid member including an open-ended upper portion, an open-ended lower portion, and first and second flanges. The open-ended upper section is formed by a floor and a first set of second parallel and spaced sidewalls extending from and substantially perpendicular to the floor. The open-ended upper portion has an opening opposite the floor and defined by the first and second parallel and spaced sidewalls. The open-ended lower portion is formed by a ceiling and a second set of parallel and spaced sidewalls that extend from and are substantially perpendicular to the ceiling. The open-ended lower portion has a second opening opposite the ceiling and defined by the third and fourth parallel and spaced sidewalls. The first flange is attached to and extends perpendicular to the third parallel and spaced sidewall and the second flange is attached to and extends perpendicular to the fourth parallel and spaced sidewall.

7 Claims, 10 Drawing Sheets

(56) References Cited

U.S. PATENT DOCUMENTS

| | | | | | |
|---|---|---|---|---|---|
| 4,733,509 | A * | 3/1988 | Takahashi | E04B 9/008 | 52/126.5 |
| 4,744,188 | A | 5/1988 | Ahren | | |
| 4,900,179 | A | 2/1990 | Kundert | | |
| 4,944,129 | A | 7/1990 | Hartleif | | |
| D348,939 | S * | 7/1994 | Larsson | D25/122 | |
| 5,359,826 | A * | 11/1994 | Grearson | E04C 3/07 | 403/363 |
| 6,317,915 | B1 * | 11/2001 | Grearson | E04B 9/001 | 14/73 |
| 6,318,042 | B1 | 11/2001 | Bloom et al. | | |
| 6,761,004 | B2 | 7/2004 | Anglin et al. | | |
| 6,971,210 | B2 | 12/2005 | Kliegle et al. | | |
| 7,287,733 | B2 * | 10/2007 | Bongio | E04B 9/127 | 248/235 |
| D598,574 | S * | 8/2009 | Bergmann | D25/122 | |
| 8,146,316 | B2 | 4/2012 | Boss et al. | | |
| 8,640,408 | B2 | 2/2014 | Wilkens | | |
| 9,206,603 | B2 * | 12/2015 | Richardson | E04B 9/06 | |
| 2002/0157332 | A1 | 10/2002 | Ziegler et al. | | |
| 2009/0255203 | A1 * | 10/2009 | Richardson | E04B 9/06 | 52/506.06 |
| 2013/0205689 | A1 | 8/2013 | Lillette et al. | | |
| 2015/0191905 | A1 * | 7/2015 | Pidcock | E04C 2/38 | 52/79.5 |

* cited by examiner

STRUT WITH NON-STRUCTURAL INFILL

FIELD OF THE INVENTION

This invention relates to ceiling grids, comprised of intersecting and perpendicular rows of elongated struts or members, that are attached to and suspended from ceilings of rooms and other building spaces, such as office spaces, storage areas, and data centers, to function as the framework for directly and/or indirectly supporting other structural members and room or building accessories. In particular, this invention relates to elongated struts or members, both structural and non-structural, that can be used in such a ceiling grid.

BACKGROUND OF THE INVENTION

Ceiling grids comprised of intersecting and perpendicular rows of elongated struts or members, both structural and non-structural struts or members, have been in use for decades. Those ceiling grids are usually directly attached to and suspended from the structure comprising the ceiling of a room or other building space, such as a concrete slab. The elongated structural struts or members of those ceiling grids directly or indirectly support other structural members and room or building accessories, such as light fixtures, HVAC conduits, sprinkler systems, etc., in the rooms or other building spaces in which they are installed.

In certain environments, it is desirable that the ceiling grids include elongated structural struts or members that have (1) the desired load capacity and (2) an architectural or aesthetic finish when viewed from underneath the ceiling grid. In addition, it is often desirable that a variety of other structural members and room or building accessories can be attached to or otherwise supported by the elongated structural struts or members at any location along the elongated structural struts or members.

While some elongated structural struts or members for ceiling grids have been developed that have (1) the desired load bearing capacity, (2) an architectural or aesthetic appearance when viewed from underneath the ceiling grid, and (3) the capability that other structural members and room or building accessories can be attached to the elongated structural struts or members at any location along the struts or members, there is always a need for elongated structural struts or members for ceiling grids with improved load bearing capacity and/or aesthetic appearance, and with the capability that other structural struts or members and room or building accessories can be attached to the elongated structural struts or members at any location along the struts or members.

In addition, there is always a need for improved elongated non-structural struts or members for ceiling grids that can be readily and securely attached to the elongated structural struts or members of those grids and have an architectural or aesthetic finish when viewed from underneath the grids.

This invention addresses those needs, as well as other needs that are readily apparent to those of skill in the art.

SUMMARY OF THE INVENTION

An elongated structural ceiling grid member according to one embodiment of this invention may include an open-ended upper portion formed by a floor and a first set of parallel and spaced sidewalls extending from and substantially perpendicular to the floor. Each of the first set of parallel and spaced sidewalls may include a lower flat wall section and an upper section that is continuous with the lower flat wall section and extends towards the other of the first set of parallel and spaced sidewalls. The upper-ended upper portion may have a first opening (1) opposite the floor and (2) defined by the upper sections of the first set of parallel and spaced sidewalls. The elongated structural ceiling grid member of this embodiment may also include an open-ended lower portion formed by a ceiling and a second set of parallel and spaced sidewalls extending from and substantially perpendicular to the ceiling. Each of the second set of parallel and spaced sidewalls may include an upper flat wall section and a lower section that is continuous with the upper flat wall section and extends towards the other of the second set of parallel spaced sidewalls. The open-ended lower portion may have a second opening (1) opposite the ceiling and the first opening and (2) defined by the second set of parallel and spaced sidewalls. The elongated structural ceiling grid member of this embodiment may also include first and second flanges. The open-ended upper portion, the open-ended lower portion and the first and second flanges may have longitudinal axes that are substantially parallel to the longitudinal axis of the elongated structural ceiling grid member. The floor and ceiling may be integral. The first flange may be attached to the lower section of one of the second set of parallel and spaced sidewalls and extend substantially perpendicular in the lateral direction to the upper flat wall section of that parallel and spaced sidewall. The second flange may be attached to the lower section of the other of the second set of parallel and spaced sidewalls and extend substantially perpendicular to the upper flat wall section of that parallel and spaced sidewall.

In some embodiments of the elongated structural ceiling grid members of this invention, the upper sections of the first set of parallel and spaced sidewalls may be hooks having free ends that are located in vertical planes between the vertical planes of the lower flat wall sections of the first set of parallel and spaced sidewalls.

In other embodiments of the elongated structural ceiling grid members of this invention, the lower sections of the second set of parallel and spaced sidewalls may be hooks that have free ends that are located in vertical planes between the vertical planes of the upper flat wall sections of the second set of parallel and spaced sidewalls.

In yet other embodiments of the elongated structural ceiling grid members of this invention, the first and second flanges may be elongated bars that extend laterally beyond and outside of the upper flat wall portions of the second set of parallel and spaced sidewalls.

In further embodiments of the elongated structural ceiling grid members of this invention, the lower flat wall portions of the first set of parallel and spaced sidewalls are in substantially the same planes as the upper flat wall portions of the second set of parallel and spaced sidewalls.

DETAILED DESCRIPTION

Figure 1:
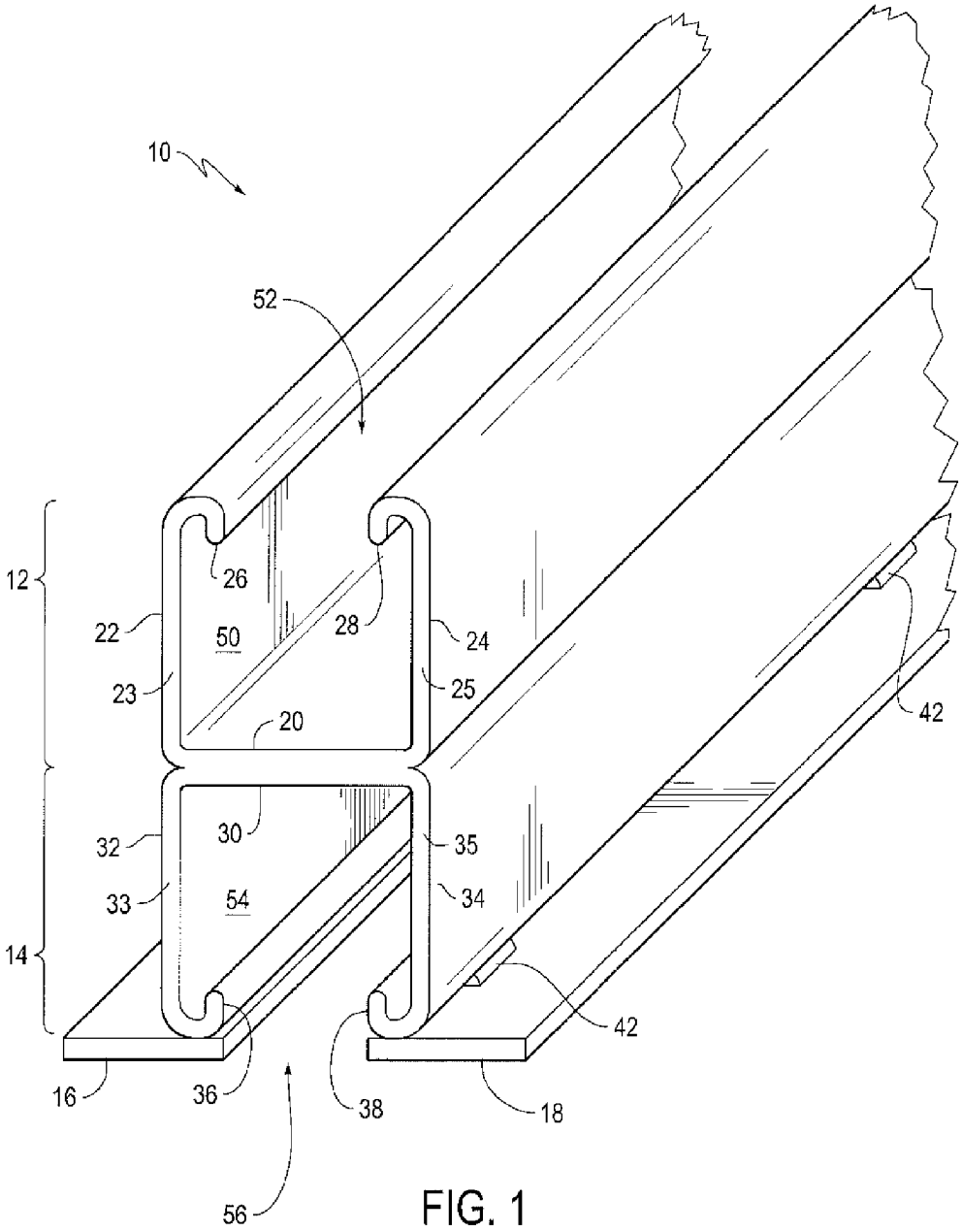
FIG. 1 is a top perspective view of an elongated structural strut for ceiling grids according to one embodiment of this invention.
Figure 2:
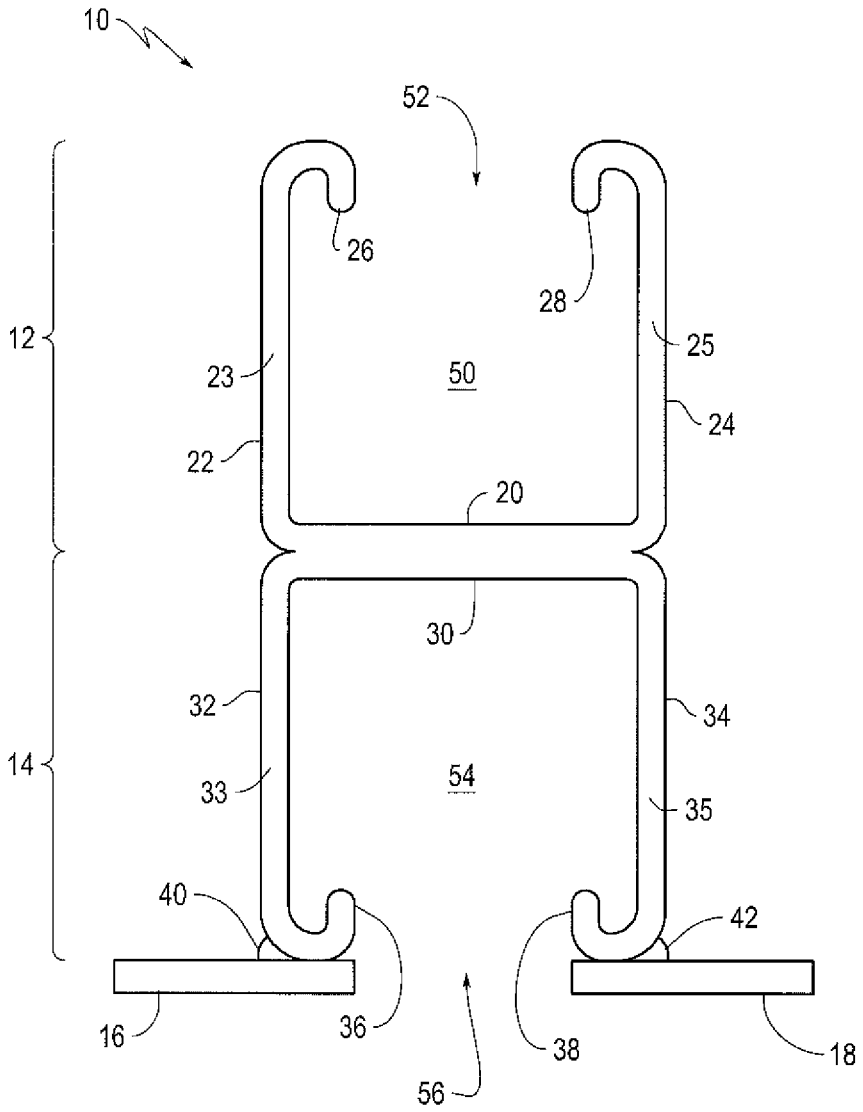
FIG. 2 is an elevation view of the elongated structural strut for ceiling grids of FIG. 1.

As stated, FIGS. 1 and 2 illustrate one embodiment of an elongated structural strut for ceiling grids of this invention, elongated structural strut 10. Elongated structural strut 10 has a longitudinal axis that extends the length of elongated structural strut 10.

Elongated structural strut 10 includes upper portion 12, lower portion 14 and lower flanges 16 and 18. In this embodiment of the elongated structural struts of the invention, upper portion 12 and lower portion 14 are integral, and extruded from stock of the same material. In other embodiments of the elongated structural struts of this invention, upper portion 12 and lower portion 14 can be two or more separate components joined together by welding or any other well-known fastening method/mechanism.

Upper portion 12 includes floor 20 and sidewalls 22 and 24, which, in this embodiment of the elongated structural struts of this invention, are integral. In other embodiments of the elongated structural struts of this invention, the floor and sidewalls of the upper portion can be multiple components joined together.

In this embodiment of the elongated structural struts of the invention, sidewalls 22 and 24 are parallel, mirror images that are substantially perpendicular to floor 20.

Also, in this embodiment of the elongated structural struts of the invention, sidewall 22 includes flat wall portion 23 and hook 26. Flat wall portion 23 begins at a longitudinal edge of floor 20 and extends upward. Hook 26 is formed by the upper portion of sidewall 22, above and continuous with flat wall portion 23.

Similarly, in this embodiment of the elongated structural struts of the invention, sidewall 24 includes flat wall portion 25 and hook 28. Flat wall portion 25 begins at the other longitudinal edge of floor 20 and extends upward. Hook 28 is formed by the upper portion of sidewall 24, above and continuous with flat wall portion 25.

Floor 20 and sidewalls 22 and 24 define upper chamber 50 with opening 52 defined by hooks 26 and 28.

The function of hooks 26 and 28 is to provide portions of sidewalls 22 and 24 that extend inwardly from flat wall portions 23 and 25, respectively, without closing opening 52. In use, hooks 26 and 28 can engage support members that are used to attach elongated structural strut 10 to a ceiling, as explained below. In other embodiments of the elongated structural struts of the invention, the upper portions of the sidewalls can have any shape that results in those portions extending inwardly, without closing the opening between the sidewalls. One advantage of hooks 26 and 28 over other "shapes" is that hooks 26 and 28 provide a "loop" to firmly engage a rod, flange, etc. that fits into and is received in the "loop."

Also, the sidewalls of the upper portions of other embodiments of the elongated structural struts of this invention do not have to include flat wall portions, such as flat wall portions 23 and 25. Rather, the sidewalls can have any configuration and/or shape that results in the sidewalls partially defining a chamber between them.

Lower portion 14 includes ceiling 30 and sidewalls 32 and 34, which, in this embodiment are integral. In other embodiments of the elongated structural struts of this invention, the ceiling and sidewalls of the lower portion can be multiple components joined together.

In this embodiment of the elongated structural struts of this invention, sidewalls 32 and 34 are parallel, mirror images that are substantially perpendicular to ceiling 30.

Also, in this embodiment of the elongated structural struts of this invention, sidewall 32 includes flat wall portion 33 and hook 36. Flat wall portion 33 begins at a longitudinal edge of ceiling 30 and extends downward. Hook 36 is formed by the lower portion of sidewall 32, below and continuous with flat wall portion 33.

Similarly, in this embodiment of the elongated structural struts of the invention, sidewall 34 includes flat wall portion 35 and hook 38. Flat wall portion 35 begins at the other longitudinal edge of ceiling 30 and extends downward. Hook 38 is formed by the lower portion of sidewall 34, below and continuous with flat wall portion 35.

Ceiling 30 and sidewalls 32 and 34 define lower chamber 54 with opening 56 defined by hooks 36 and 38 (and the innermost ends of flanges 16 and 18).

The function of hooks 36 and 38 is to provide portions of sidewalls 32 and 34 that extend inwardly from flat wall portions 33 and 35, respectively, without closing opening 56. In use, hooks 36 and 38 can engage or otherwise support other structural members, room and building accessories, apparatus to support room and building accessories, etc. In other embodiments of the elongated structural struts of this invention, the lower portions of the sidewalls can have any shape that results in those portions extending inwardly, without closing the opening between the sidewalls. As stated above, one advantage of hooks 36 and 38 over other "shapes" is that hooks 36 and 38 provide a "loop" to firmly engage a rod, flange, etc. that fits into and is received in the "loop."

Also, the sidewalls of the lower portions of other embodiments of the elongated structural struts of this invention do not have to include flat wall portions, such as flat wall portions 33 and 35. Rather, the sidewalls can have any configuration and/or shape that results in the sidewalls partially defining a chamber between them.

As can be determined from FIGS. 1 and 2, in this embodiment of the elongated structural struts of the invention, flat wall portions 23 and 33 of sidewalls 22 and 32 are in substantially the same planes and flat wall portions 25 and 35 of sidewalls 24 and 34 are in substantially the same planes.

Flange 16 is attached to hook 36 of sidewall 32 by spot welds, such as spot welds 40, as shown in FIG. 2. Flange 16 is oriented substantially perpendicular to flat wall portion 33 of sidewall 32 in the lateral direction and abuts sidewall 32 at the apex of hook 36. Flange 16 extends laterally beyond and outside of flat wall portion 33 to provide a surface to support other structural members, room and building accessories, etc. The inner surface of flange 16 is in substantially the same plane as the innermost surface of hook 36.

Similarly, flange 18 is attached to hook 38 of sidewall 34 by spot welds 42, as shown in FIGS. 1 and 2. Flange 18 is oriented substantially perpendicular to flat wall portion 35 of sidewall 34 in the lateral direction and abuts sidewall 34 at the apex of hook 38. Flange 18 extends laterally beyond and outside of flat wall portion 35 to provide a surface to support other structural members, room and building accessories, etc. The inner surface of flange 18 is in substantially the same plane as the innermost surface of hook 38.

While, in this embodiment of the elongated structural struts of this invention, flanges 16 and 18 are elongated bars attached to lower portion 14, in other embodiments of the elongated structural struts of this invention, flanges 16 and 18 can be integral with lower portion 14. Also, in yet other embodiments of the elongated structural struts of this invention, flanges 16 and 18 can have a shape other than an elongated bar, as long as they include a portion that can support other structural members and room and building accessories such as light fixtures, HVAC conduits, piping, etc.

As can be determined from FIGS. 1 and 2, each of upper portion 12, lower portion 14 and flanges 16 and 18 has a longitudinal axis that is substantially parallel to the longitudinal axis of elongated structural strut 10.

Figure 3:
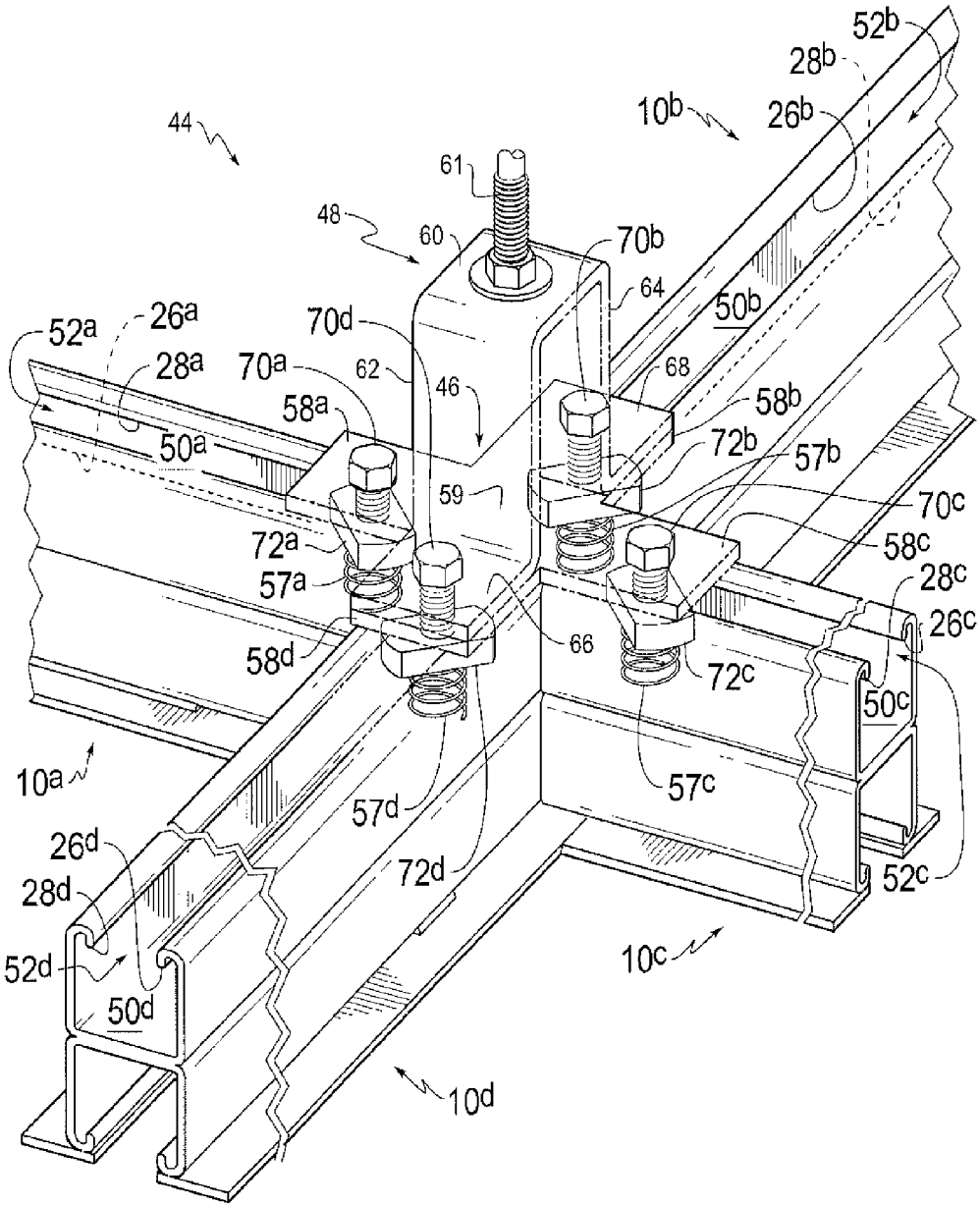
FIG. 3 is a top perspective view, partially sectionalized and partially in phantom for clarity, of four of the elongated structural strut for ceiling grids illustrated in FIGS. 1 and 2, joined by a connector to form intersecting and perpendicular rows of the struts.

As stated, FIG. 3 illustrates four of the elongated structural strut for ceiling grids illustrated in FIGS. 1 and 2 and described above, elongated structural struts $\mathbf{10}^a$, $\mathbf{10}^b$, $\mathbf{10}^c$ and $\mathbf{10}^d$, connected at one of their ends to form intersecting and perpendicular rows of the struts. Elongated structural struts $\mathbf{10}^a$, $\mathbf{10}^b$, $\mathbf{10}^c$ and $\mathbf{10}^d$ are joined by connector assembly 44, which includes wing member 46 and U-shaped connector 48.

Wing member 46 is a flat member that includes center portion 59 and integral wings $\mathbf{58}^a$, $\mathbf{58}^b$, $\mathbf{58}^c$ and $\mathbf{58}^d$ that extend outward from center portion 59. Wings $\mathbf{58}^a$, $\mathbf{58}^b$, $\mathbf{58}^c$ and $\mathbf{58}^d$ are oriented at 90° from each other. Wings $\mathbf{58}^a$, $\mathbf{58}^b$, $\mathbf{58}^c$ and $\mathbf{58}^d$ are affixed to elongated structural struts $\mathbf{10}^a$, $\mathbf{10}^b$, $\mathbf{10}^c$ and $\mathbf{10}^d$, respectively, as described below.

U-shaped connector 48 is a continuous member formed of top portion 60, sidewalls 62 and 64 and mating flanges 66 and 68. Mating flange 66 mates with wing $\mathbf{58}^d$ and is affixed to elongated structural strut $\mathbf{10}^d$ with wing $\mathbf{58}^d$. Mating flange 68 mates with wing $\mathbf{58}^b$ and is affixed to elongated structural strut $\mathbf{10}^b$ with wing $\mathbf{58}^b$.

While, in this embodiment of the invention, wing member 46 and U-shaped connector 48 are separate components, in other embodiments, they can be integral. Also, in other embodiments, the connector assembly can be of any shape or configuration as long as it has surfaces that can be attached to four elongated structural struts that are arranged to form intersecting and perpendicular rows of the struts and a surface that enables it to be connected to a ceiling rod assembly, as described below, or to any other apparatus employed to attach and suspend the connector assembly to and from a ceiling.

In this embodiment of the invention, wing $\mathbf{58}^a$ is attached to elongated structural strut $\mathbf{10}^a$ by bolt $\mathbf{70}^a$ and retaining block $\mathbf{72}^a$, wing $\mathbf{58}^b$ and mating flange 68 are attached to elongated structural strut $\mathbf{10}^b$ by bolt $\mathbf{70}^b$ and retaining block $\mathbf{72}^b$, wing $\mathbf{58}^c$ is attached to elongated structural strut $\mathbf{10}^c$ by bolt $\mathbf{70}^c$ and retaining block $\mathbf{72}^c$, and wing $\mathbf{58}^d$ and mating flange 66 are attached to elongated structural strut $\mathbf{10}^d$ by bolt $\mathbf{70}^d$ and retaining block $\mathbf{72}^d$, respectively. Bolts $\mathbf{70}^a$, $\mathbf{70}^b$, $\mathbf{70}^c$ and $\mathbf{70}^d$ have external threads that threadedly engage internal threads of holes in retaining blocks $\mathbf{72}^a$, $\mathbf{72}^b$, $\mathbf{72}^c$ and $\mathbf{72}^d$, respectively. The shafts of bolts $\mathbf{70}^a$, $\mathbf{70}^b$, $\mathbf{70}^c$ and $\mathbf{70}^d$ are received in holes in wings $\mathbf{58}^a$, $\mathbf{58}^b$, $\mathbf{58}^c$ and $\mathbf{58}^d$, respectively. The shafts of bolts $\mathbf{70}^b$ and $\mathbf{70}^d$ are also received in holes in mating flanges 68 and 66, respectively. Retaining blocks $\mathbf{72}^a$, $\mathbf{72}^b$, $\mathbf{72}^c$ and $\mathbf{72}^d$ have a width less than, but a length greater than, the width of openings $\mathbf{52}^a$, $\mathbf{52}^b$, $\mathbf{52}^c$ and $\mathbf{52}^d$ of upper portions $\mathbf{12}^a$, $\mathbf{12}^b$, $\mathbf{12}^c$ and $\mathbf{12}^d$ of elongated structural struts $\mathbf{10}^a$, $\mathbf{10}^b$, $\mathbf{10}^c$ and $\mathbf{10}^d$, respectively, for reasons described below.

Connector assembly 44 can be attached to elongated structural struts $\mathbf{10}^a$, $\mathbf{10}^b$, $\mathbf{10}^c$ and $\mathbf{10}^d$ in at least the following ways.

Figure 9B:
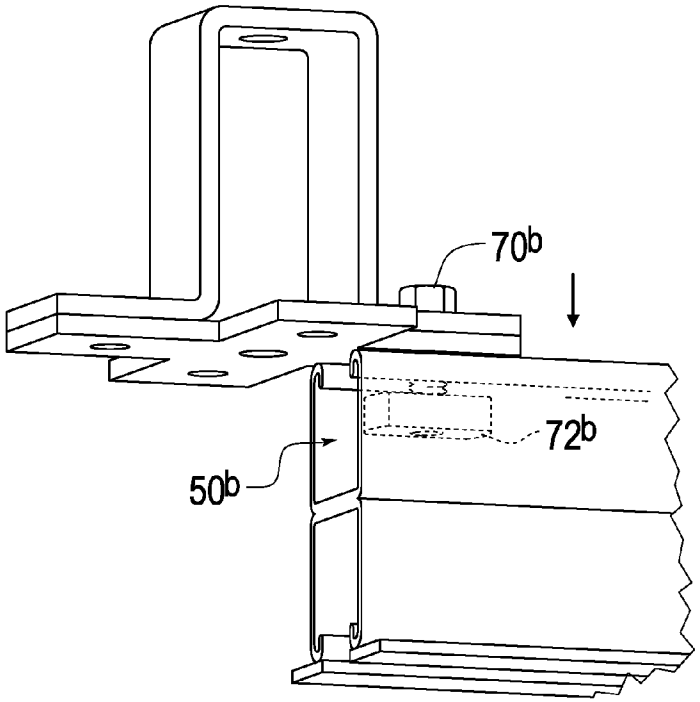
FIGS. 9A, 9B, 9C and 9D are a series of schematic views illustrating how the connector of FIG. 3 can be attached to the elongated structural strut for ceiling grids of FIGS. 1 and 2.
Figure 9A:
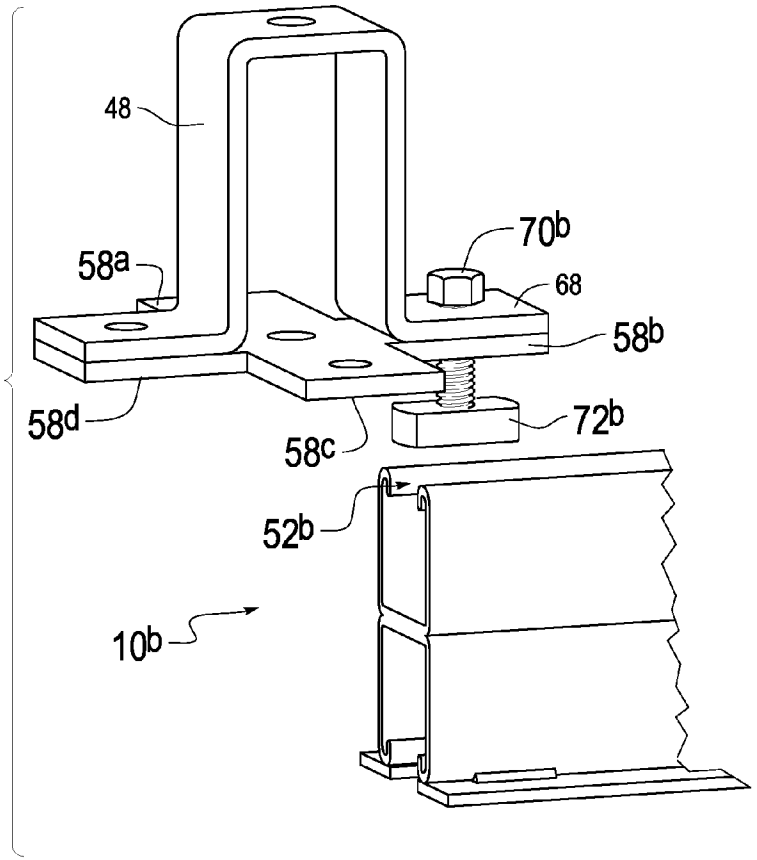

One way is illustrated, in part, by FIGS. 9A-9D. First, before connector assembly 44 is placed on elongated structural struts $\mathbf{10}^a$, $\mathbf{10}^b$, $\mathbf{10}^c$ and $\mathbf{10}^d$, bolt $\mathbf{70}^a$ and retaining block $\mathbf{72}^a$ are loosely connected to wing $\mathbf{58}^a$, bolt $\mathbf{70}^b$ and retaining block $\mathbf{72}^b$ are loosely connected to wing $\mathbf{58}^b$ and mating flange 68, bolt $\mathbf{70}^c$ and retaining block $\mathbf{72}^c$ are loosely connected to wing $\mathbf{58}^c$, and bolt $\mathbf{70}^d$ and retaining block $\mathbf{72}^d$ are loosely connected to wing $\mathbf{58}^d$ and mating flange 66 (the loose connection of bolt $\mathbf{70}^b$ and retaining block $\mathbf{72}^b$ to wing $\mathbf{58}^b$ and mating flange 68 is illustrated in FIG. 9A). Connector assembly 44 is then positioned above elongated structural struts $\mathbf{10}^a$, $\mathbf{10}^b$, $\mathbf{10}^c$ and $\mathbf{10}^d$, with wing $\mathbf{58}^a$ located above elongated structural strut 10, wing $\mathbf{58}^b$ and mating flange 68 located above elongated structural strut $\mathbf{10}^b$, wing $\mathbf{58}^c$ located above elongated structural strut $\mathbf{10}^c$, and wing $\mathbf{58}^d$ and mating flange 66 located above elongated structural strut $\mathbf{10}^d$. Alternatively, if connector assembly 44 is already installed, elongated structural struts $\mathbf{10}^a$, $\mathbf{10}^b$, $\mathbf{10}^c$ and $\mathbf{10}^d$ are positioned below connector assembly 44, with elongated structural strut $\mathbf{10}^a$ located below wing $\mathbf{58}^a$, elongated structural strut $\mathbf{10}^b$ below wing $\mathbf{58}^b$ and mating flange 68, elongated structural strut $\mathbf{10}^c$ below wing $\mathbf{58}^c$, and elongated structural strut $\mathbf{10}^d$ below wing $\mathbf{58}^d$ and mating flange 66.

Either way, retaining blocks $\mathbf{72}^a$, $\mathbf{72}^b$, $\mathbf{72}^c$ and $\mathbf{72}^d$ are positioned relative to openings $\mathbf{52}^a$, $\mathbf{52}^b$, $\mathbf{52}^c$ and $\mathbf{52}^d$ such that the widths of retaining blocks $\mathbf{72}^a$, $\mathbf{72}^b$, $\mathbf{72}^c$ and $\mathbf{72}^d$ are substantially aligned with openings $\mathbf{52}^a$, $\mathbf{52}^b$, $\mathbf{52}^c$ and $\mathbf{52}^d$, so that retaining blocks $\mathbf{72}^a$, $\mathbf{72}^b$, $\mathbf{72}^c$ and $\mathbf{72}^d$ can fit through openings $\mathbf{52}^a$, $\mathbf{52}^b$, $\mathbf{52}^c$ and $\mathbf{52}^d$, respectively. The alignment of retaining block $\mathbf{72}^b$ with opening $\mathbf{52}^b$ is illustrated in FIG. 9A.

Next, connector assembly 44 is lowered, or elongated structural struts $\mathbf{10}^a$, $\mathbf{10}^b$, $\mathbf{10}^c$ and $\mathbf{10}^d$ are raised (if connector assembly 44 is already installed), until retaining blocks $\mathbf{72}^a$, $\mathbf{72}^b$, $\mathbf{72}^c$ and $\mathbf{72}^d$ pass through openings $\mathbf{52}^a$, $\mathbf{52}^b$, $\mathbf{52}^c$ and $\mathbf{52}^d$ and are received in chambers $\mathbf{50}^a$, $\mathbf{50}^b$, $\mathbf{50}^c$ and $\mathbf{50}^d$, respectively. As noted above, the width of retaining blocks $\mathbf{72}^a$, $\mathbf{72}^b$, $\mathbf{72}^c$ and $\mathbf{72}^d$ is less than the widths of openings $\mathbf{52}^a$, $\mathbf{52}^b$, $\mathbf{52}^c$ and $\mathbf{52}^d$, respectively. The passing of retaining block $\mathbf{72}^b$ through opening $\mathbf{52}^b$ into chamber $\mathbf{50}^b$ is illustrated in FIG. 9B.

Figure 9D:
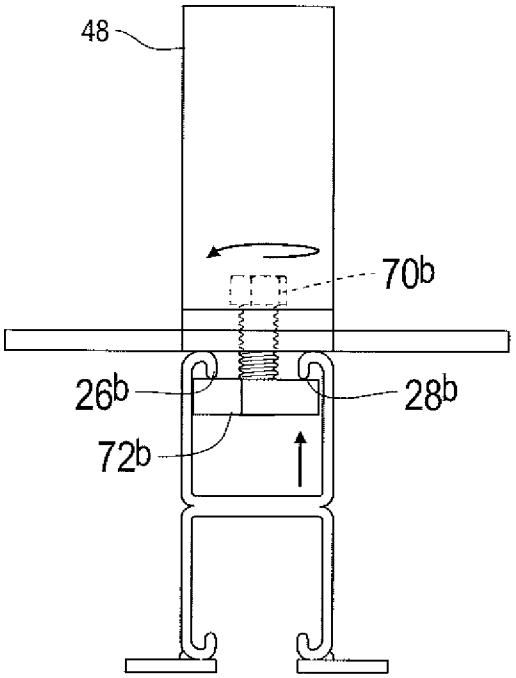
Figure 9C:
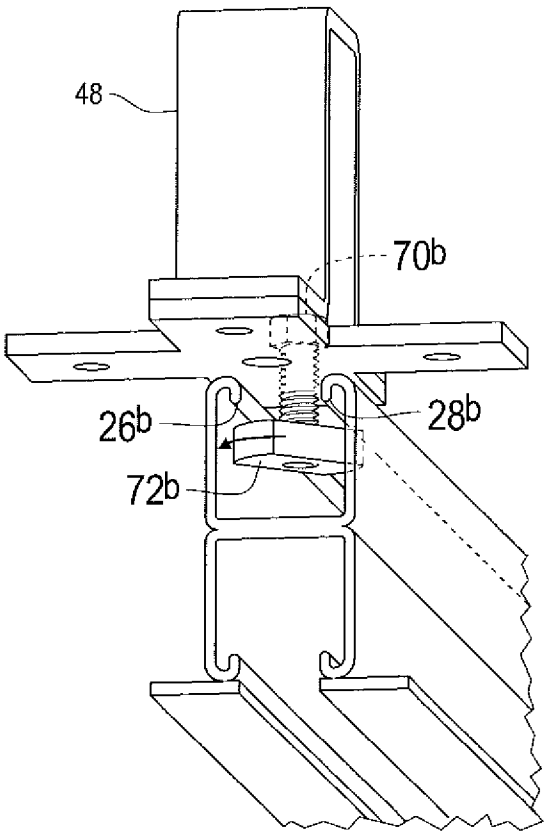

Once the top surfaces of retaining blocks $\mathbf{72}^a$, $\mathbf{72}^b$, $\mathbf{72}^c$ and $\mathbf{72}^d$ pass below the free end of hooks $\mathbf{26}^a$ and $\mathbf{28}^a$, hooks $\mathbf{26}^b$ and $\mathbf{28}^b$, hooks $\mathbf{26}^c$ and $\mathbf{28}^c$, and hooks $\mathbf{26}^d$ and $\mathbf{28}^d$, respectively, retaining blocks $\mathbf{72}^a$, $\mathbf{72}^b$, $\mathbf{72}^c$ and $\mathbf{72}^d$ are rotated such that portions of retaining blocks $\mathbf{72}^a$, $\mathbf{72}^b$, $\mathbf{72}^c$ and $\mathbf{72}^d$ overlap the free ends of those hooks. The rotation of retaining block $\mathbf{72}^b$ is illustrated in FIG. 9C.

Bolts 70$^a$, 70$^b$, 70$^c$ and 70$^d$ are then tightened until retaining blocks 72$^a$, 72$^b$, 72$^c$ and 72$^d$ firmly engage the free ends of hooks 26$^a$ and 28$^a$, hooks 26$^b$ and 28$^b$, hooks 26$^c$ and 28$^c$, and hooks 26$^d$ and 28$^d$, respectively. The tightening of bolt 70$^b$ and engagement of retaining block 72$^b$ with the free ends of hooks 26$^b$ and 28$^b$ are illustrated in FIG. 9D.

Another way of connecting connector assembly 44 to elongated structural struts 10$^a$, 10$^b$, 10$^c$ and 10$^d$, i.e., connecting wing 58$^a$ to elongated structural strut 10$^a$ by bolt 70$^a$ and retaining block 72$^a$, wing 58$^b$ and mating flange 68 to elongated structural strut 10$^b$ by bolt 70$^b$ and retaining block 72$^b$, wing 58$^a$ to elongated structural strut 10$^c$ by bolt 70$^c$ and retaining block 72$^c$, and wing 58$^d$ and mating flange 66 to elongated structural strut 10$^d$ by bolt 70$^d$ and retaining block 72$^d$, is as follows. Connector assembly 44 is placed on elongated structural struts 10$^a$, 10$^b$, 10$^c$ and 10$^d$ such that wing 58$^a$ is above elongated structural strut 10$^a$, wing 58$^b$ and mating flange 68 are above elongated structural strut 10$^b$, wing 58$^c$ is above elongated structural strut 10$^c$, and wing 58$^d$ and mating flange 66 are above elongated structural strut 10$^d$, but without bolts 70$^a$, 70$^b$, 70$^c$ and 70$^d$ and retaining blocks 72$^a$, 72$^b$, 72$^c$ and 72$^d$ attached thereto. Alternatively, if connector assembly 44 is already installed, elongated structural struts 10$^a$, 10$^b$, 10$^c$ and 10$^d$ are positioned below connector assembly 44 such that elongated structural strut 10$^a$ is below wing 58$^a$, elongated structural strut 10$^b$ is below wing 58$^b$ and mating flange 68, elongated structural strut 10$^a$ is below wing 58$^a$, and elongated structural strut 10$^d$ is below wing 58$^d$ and mating flange 66, but without bolts 70$^a$, 70$^b$, 70$^c$ and 70$^d$ and retaining blocks 72$^a$, 72$^b$, 72$^c$ and 72$^d$ attached thereto.

Once connector assembly 44 and elongated structural struts 10$^a$, 10$^b$, 10$^c$ and 10$^d$ are in the proper relative position, bolts 70$^a$, 70$^b$, 70$^c$ and 70$^d$ are inserted through the holes in wing 58$^a$, wing 58$^b$ and mating flange 68, wing 58$^c$, and wing 58$^d$ and mating flange 66, respectively. The lower ends of bolts 70$^a$, 70$^b$, 70$^c$ and 70$^d$ extend into upper chambers 50$^a$, 50$^b$, 50$^c$ and 50$^d$ through openings 52$^a$, 52$^b$, 52$^c$ and 52$^d$, respectively. Retaining blocks 72$^a$, 72$^b$, 72$^c$ and 72$^d$ are then positioned on the threaded ends of bolts 70$^a$, 70$^b$, 70$^c$ and 70$^d$, respectively, such that areas of retaining blocks 72$^a$, 72$^b$, 72$^c$ and 72$^d$ overlap with hooks 26$^a$ and 28$^a$, hooks 26$^b$ and 28$^b$, hooks 26$^c$ and 28$^c$, and hooks 26$^d$ and 28$^d$, respectively. Bolts 70$^a$, 70$^b$, 70$^c$ and 70$^d$ are then tightened until retaining blocks 72$^a$, 72$^b$, 72$^c$ and 72$^d$ firmly engage hooks 26$^a$ and 28$^a$, hooks 26$^b$ and 28$^b$, hooks 26$^c$ and 28$^c$, and hooks 26$^d$ and 28$^d$, respectively.

Yet another way of connecting connector assembly 44 to elongated structural struts 10$^a$, 10$^b$, 10$^c$ and 10$^d$, i.e., connecting wing 58$^a$ to elongated structural strut 10$^a$ by bolt 70$^a$ and retaining block 72$^a$, wing 58$^b$ and mating flange 68 to elongated structural strut 10$^b$ by bolt 70$^b$ and retaining block 72$^b$, wing 58$^c$ to elongated structural strut 10$^c$ by bolt 70$^c$ and retaining block 72$^c$, and wing 58$^d$ and mating flange 66 to elongated structural strut 10$^d$ by bolt 70$^d$ and retaining block 72$^d$, is as follows. Retaining blocks 72$^a$, 72$^b$, 72$^c$ and 72$^d$ are positioned in upper chambers 50$^a$, 50$^b$, 50$^c$ and 50$^d$ such that portions of retaining blocks 72$^a$, 72$^b$, 72$^c$ and 72$^d$ overlap with hooks 26$^a$ and 28$^a$, hooks 26$^b$ and 28$^b$, hooks 26$^c$ and 28$^c$ and hooks 26$^d$ and 28$^d$, respectively. Springs, such as springs 57$^a$, 57$^b$, 57$^c$ and 57$^d$ in FIG. 3, are positioned in upper chambers 50$^a$, 50$^b$, 50$^c$ and 50$^d$ between retaining blocks 72$^a$, 72$^b$, 72$^c$ and 72$^d$ and floors 20$^a$, 20$^b$, 20$^c$ and 20$^d$ of upper portions 12$^a$, 12$^b$, 12$^c$ and 12$^d$, respectively, to "push" retaining blocks 72$^a$, 72$^b$, 72$^c$ and 72$^d$ in fixed positions against the free ends of hooks 26$^a$ and 28$^a$, hooks 26$^b$ and 28$^b$, hooks 26$^c$ and 28$^c$ and hooks 26$^d$ and 28$^d$, respectively. Bolts 70$^a$, 70$^b$, 70$^c$ and 70$^d$ are then inserted through the holes in wing 46$^a$, wing 46$^b$ and mating portion 68, wing 46$^c$ and wing 46$^d$ and mating portion 66, and tightened to firmly engage retaining blocks 72$^a$, 72$^b$, 72$^c$ and 72$^d$ against the free ends of hooks 26$^a$ and 28$^a$, hooks 26$^b$ and 28$^b$, hooks 26$^c$ and 28$^c$, and hooks 26$^d$ and 28$^d$, respectively.

Connector assembly 44 can be attached to and suspended from the structure comprising a ceiling of a room or other building area, such as a concrete slab, as follows. One end of a ceiling rod assembly, such as ceiling rod assembly 61 in FIG. 3, is attached to the ceiling structure. The other end of ceiling rod assembly 61 is attached to top portion 60 of U-shaped connector 48.

Figure 4:
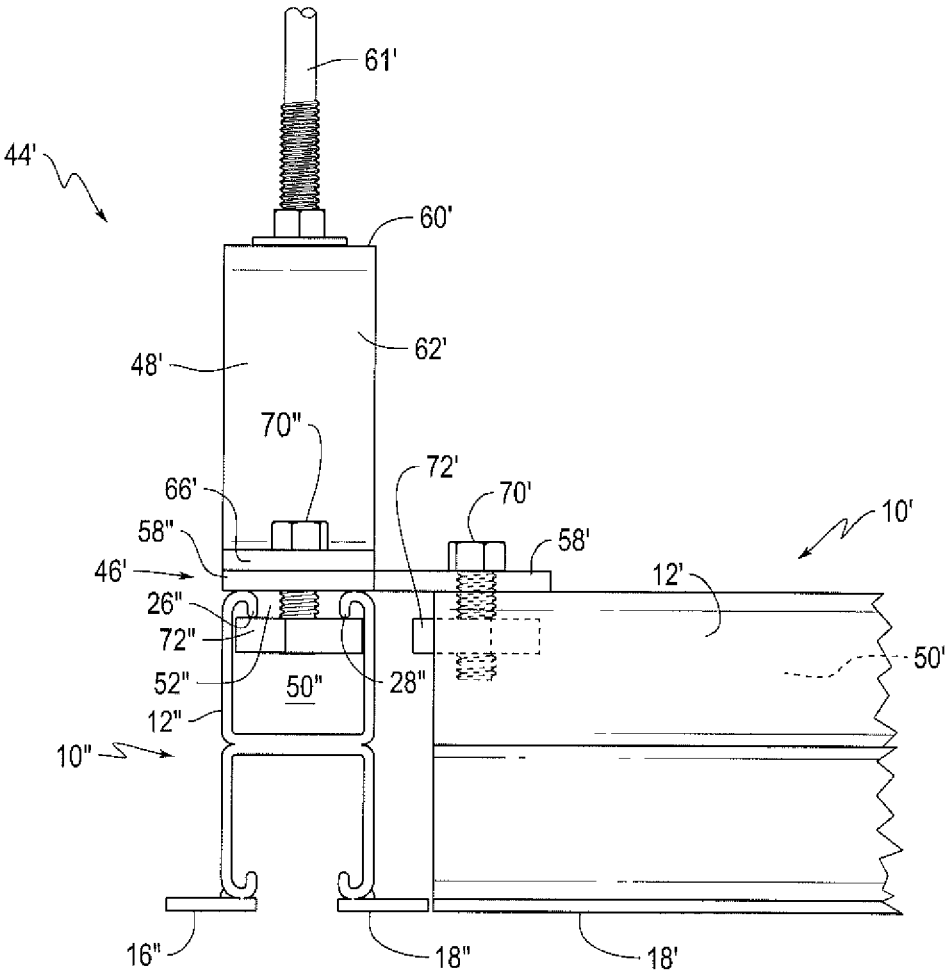
FIG. 4 is an elevation view of three of the elongated structural strut for ceiling grids illustrated in FIGS. 1 and 2, joined by a connector to form a T-intersection of the struts.

As stated, FIG. 4 illustrates three of the elongated structural strut for ceiling grids illustrated in FIG. 1 and 2 and described above, elongated structural struts 10', 10" and 10'", joined at one of their ends to form a T-intersection of a ceiling grid (elongated structural strut 10'" is not shown in FIG. 4, but is behind and axially in line with elongated structural strut 10"). Elongated structural struts 10', 10" and 10'" are joined by connector assembly 44', which includes T-shaped member 46' and U-shaped connector 48'.

T-shaped member 46' is a flat member that includes center portion 59' (not shown) and integral wings 58', 58" and 58'" that (1) extend outward from center portion 59' and (2) are oriented 90° to each other to form a "T" (wing 58'" is not shown in FIG. 4, but is behind and in the same planes as wing 58").

The same as U-shaped connector 48, U-shaped connector 48' is a continuous member formed of top portion 60', sidewalls 62' and 64' and mating flanges 66' and 68' (sidewall 64' and mating flange 68' are not shown in FIG. 4).

While in this embodiment of the invention, T-shaped member 46' and U-shaped connector 48' are separate components, in other embodiments, they can be integral. Also, in other embodiments, the connector assembly can be of any shape or configuration as long as it has surfaces that can be attached to the three elongated structural struts forming the T-intersection and a surface that enables it to be connected to a ceiling rod assembly, or to any other apparatus employed to attach and suspend the ceiling grid to and from a ceiling.

Connector assembly 44' can be attached to elongated structural struts 10', 10" and 10'" in the same ways that connector assembly 44 can be attached to elongated structural struts 10$^a$, 10$^b$, 10$^c$ and 10$^d$. Specifically, wing 58' is attached to elongated structural strut 10' by bolt 70' and retaining block 72', wing 58" and mating flange 66' are attached to elongated structural strut 10" by bolt 70" and retaining block 72", and wing 58'" and mating flange 68' are attached to elongated structural strut 10'" by bolt 70'" and retaining block 72'" (bolt 70'" and retaining block 72'" are not shown in FIG. 4). Like bolts 70$^a$, 70$^b$, 70$^c$ and 70$^d$ and retaining blocks 72$^a$, 72$^b$, 72$^c$ and 72$^d$, bolts 70', 70" and 70'" have external threads that threadedly engage internal threads of holes in retaining blocks 72', 72" and 72'", respectively. Also, like retaining blocks 72$^a$, 72$^b$, 72$^c$ and 72$^d$, retaining blocks 72', 72" and 72'" have a width less than, but a length greater than, the width of openings 52', 52" and 52'" of upper portions 12', 12" and 12'" of elongated structural struts 10', 10" and 10'", respectively.

The end result is that retaining blocks 72', 72" and 72'" are received in upper chambers 50', 50" and 50'" of upper portions 12', 12" and 12'" of elongated structural struts 10', 10" and 10'" and firmly engage the free ends of hooks 26' and 28', hooks 26" and 28", and hooks 26'" and 28'", respectively.

In this embodiment, when elongated structural struts 10' and 10" are joined by connector assembly 44', flanges 16' (not shown) and 18' abut flange 18", as shown in FIG. 4.

Connector assembly 44' can be attached to and suspended from ceiling structure by ceiling rod assembly 61' in the same manner that connector assembly 44 can be attached to and suspended from ceiling structure by ceiling rod assembly 61.

In other embodiments, a connector assembly other than connector assembly 44' can be used to join elongated structural struts 10', 10" and 10'" in the configuration of a T-intersection.

Figure 10:
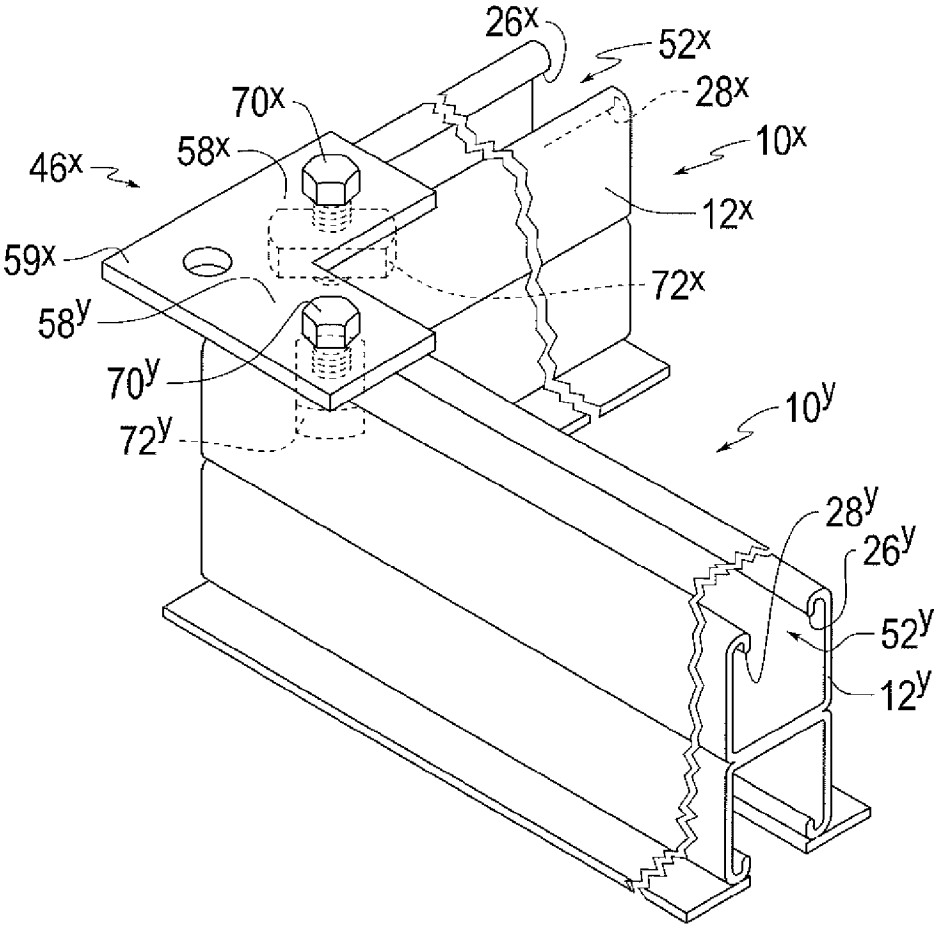
FIG. 10 is a top perspective view, partially in phantom for clarity, of two of the elongated structural strut for ceiling grids illustrated in FIGS. 1 and 2, joined by a connector to form a corner of a ceiling grid.

As stated, FIG. 10 illustrates two of the elongated structural strut for ceiling grids illustrated in FIGS. 1 and 2 and described above, elongated structural struts $10^x$ and $10^y$, joined at one of their ends to form a corner of a ceiling grid. Elongated structural struts $10^x$ and $10^y$ are joined by L-shaped member $46^x$.

In this embodiment, L-shaped member $46^x$ is a flat member that includes center portion $59^x$ and integral wings $58^x$ and $58^y$ that (1) extend outward from center portion $59^x$ and (2) are oriented 90° to each other to form an "L." In other embodiments, the member that joins the elongated structural struts can be of any shape or configuration as long as it has surfaces that can be attached to the two elongated structural struts forming the grid corner.

L-shaped member $46^x$ can be attached to elongated structural struts $10^x$ and $10^y$ in the same ways that connector assembly 44 can be attached to elongated structural struts $10^a$, $10^b$, $10^c$ and $10^d$. Specifically, wing $58^x$ is attached to elongated structural strut $10^x$ by bolt $70^x$ and retaining block $72^x$ and wing $58^y$ is attached to elongated structural strut $10^y$ by bolt $70^y$ and retaining block $72^y$. Like bolts $70^a$, $70^b$, $70^c$ and $70^d$ and retaining blocks $72^a$, $72^b$, $72^c$ and $72^d$, bolts $70^x$ and $70^y$ have external threads that threadedly engage internal holes in retaining blocks $72^x$ and $72^y$, respectively. Also, like retaining blocks $72^a$, $72^b$, $72^c$ and $72^d$, retaining blocks $72^x$ and $72^y$ have a width less than, but a length greater than, the width of openings $52^x$ and $52^y$ of upper portions $12^x$ and $12^y$ of elongated structural struts $10^x$ and $10^y$, respectively.

The end result is that retaining blocks $72^x$ and $72^y$ are received in upper chambers $50^x$ and $50^y$ of upper portions $12^x$ and $12^y$ of elongated structural struts $10^x$ and $10^y$ and firmly engage the free ends of hooks $26^x$ and $28^x$ and hooks $26^y$ and $28^y$, respectively.

Figure 5:
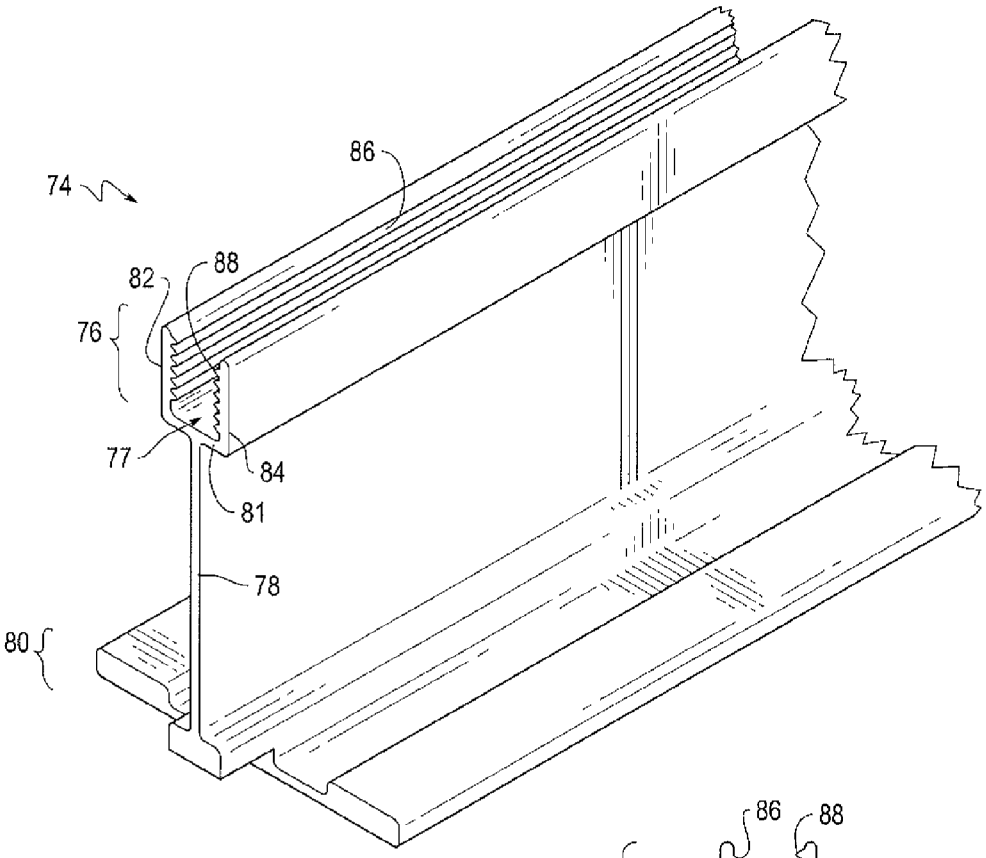
FIG. 5 is a top perspective view of an elongated non-structural strut for ceiling grids according to one embodiment of this invention.
Figure 6:
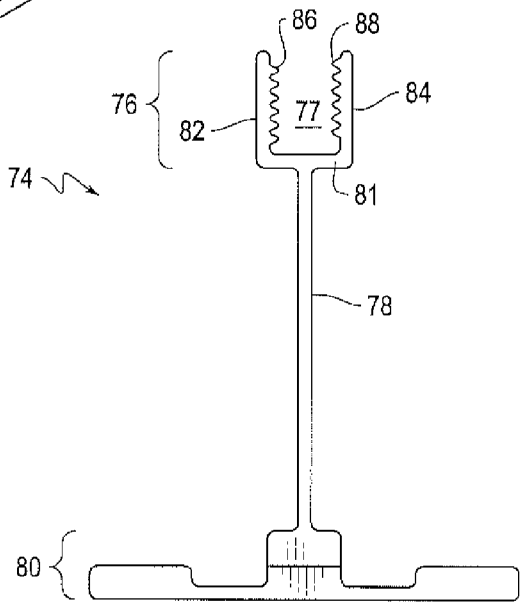
FIG. 6 is an elevation view of the elongated non-structural strut for ceiling grids of FIG. 5.

As stated, FIGS. 5 and 6 illustrate one embodiment of a non-structural elongated member, non-structural elongated member 74, which can be used in a ceiling grid with the elongated structural struts of this invention.

Non-structural elongated member 74 includes upper portion 76, web 78 and flange portion 80. While, in this embodiment of the invention, upper portion 76, web 78 and flange portion 80 are integral, in other embodiments, they can be comprised of two or more components, welded or otherwise fastened together.

Upper portion 76 includes floor 81 and spaced and parallel sidewalls 82 and 84 that extend upward from the two longitudinal edges of floor 81 to form a U-shape with floor 81. Sidewall 82 includes threads 86 on its inner surface, and sidewall 84 includes threads 88 on its inner surface. Floor 81 and sidewalls 82 and 84 form or define threaded slot 77. Threads 86 and 88 are offset one half turn vertically from each other, as shown in FIG. 6. That is, each peak of thread 86 is diametrically opposed by a valley of thread 88, and each valley of thread 86 is diametrically opposed by a peak of thread 88.

Flange portion 80 is oriented substantially perpendicular to web 78. The bottom surface of flange portion 80 is what is visible to occupants of the room or building space that includes a ceiling grid with one or more non-structural elongated members 74.

Figure 7:
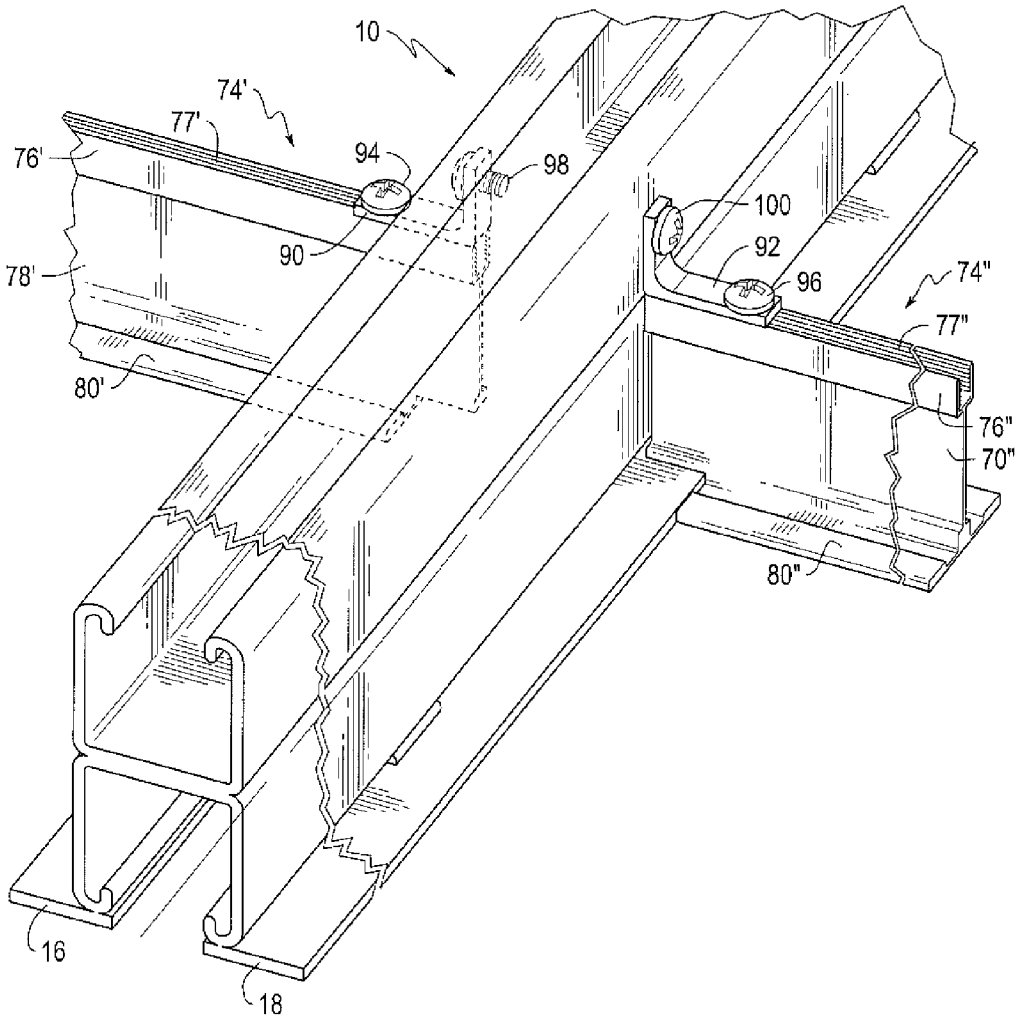
FIG. 7 is a top perspective view of two of the elongated non-structural strut of FIGS. 5 and 6 attached to an elongated structural strut of FIGS. 1 and 2, to form an intersection of perpendicular rows of the elongated non-structural struts and the elongated structural struts.

As stated, FIG. 7 illustrates a pair of the non-structural elongated member of FIGS. 5 and 6, non-structural elongated members 74' and 74", attached on opposite sides of elongated structural strut 10, to form intersecting and perpendicular rows of the elongated structural struts and the non-structural elongated members. Specifically, non-structural elongated member 74' is attached to one side of elongated structural strut 10 by connector 90, and non-structural elongated member 74" is attached to the opposite side of elongated structural strut 10 by connector 92.

In this embodiment, connectors 90 and 92 are L-shaped. The bottom arms of connectors 90 and 92 are attached to non-structural elongated members 74' and 74" by bolts 94 and 96 that threadedly engage threaded slots 77' and 77" of non-structural elongated members 74' and 74", respectively. The upper arms of L-shaped connectors 90 and 92 are attached to sidewalls 22 and 24 of upper portion 12 of elongated structural strut 10 by screws 98 and 100, respectively.

In this embodiment, the ends of flange portions 80' and 80" are recessed from the ends of upper portions 76' and 76" and webs 78' and 78", as shown in FIGS. 5 and 7, so that the bottom surfaces of flange portions 80' and 80" of non-structural elongated members 74' and 74" and of flanges 16 and 18 of elongated structural strut 10 form a substantially flat surface.

FIG. 7 illustrates one way of connecting the elongated structural struts and the non-structural elongated members of this invention to form intersecting and perpendicular rows of those struts and members. In other embodiments, the elongated structural struts and non-structural elongated members can be attached using different methods/apparatus that are sufficient to maintain the elongated structural struts and the non-structural elongated members in the desired relative positions.

Figure 8:
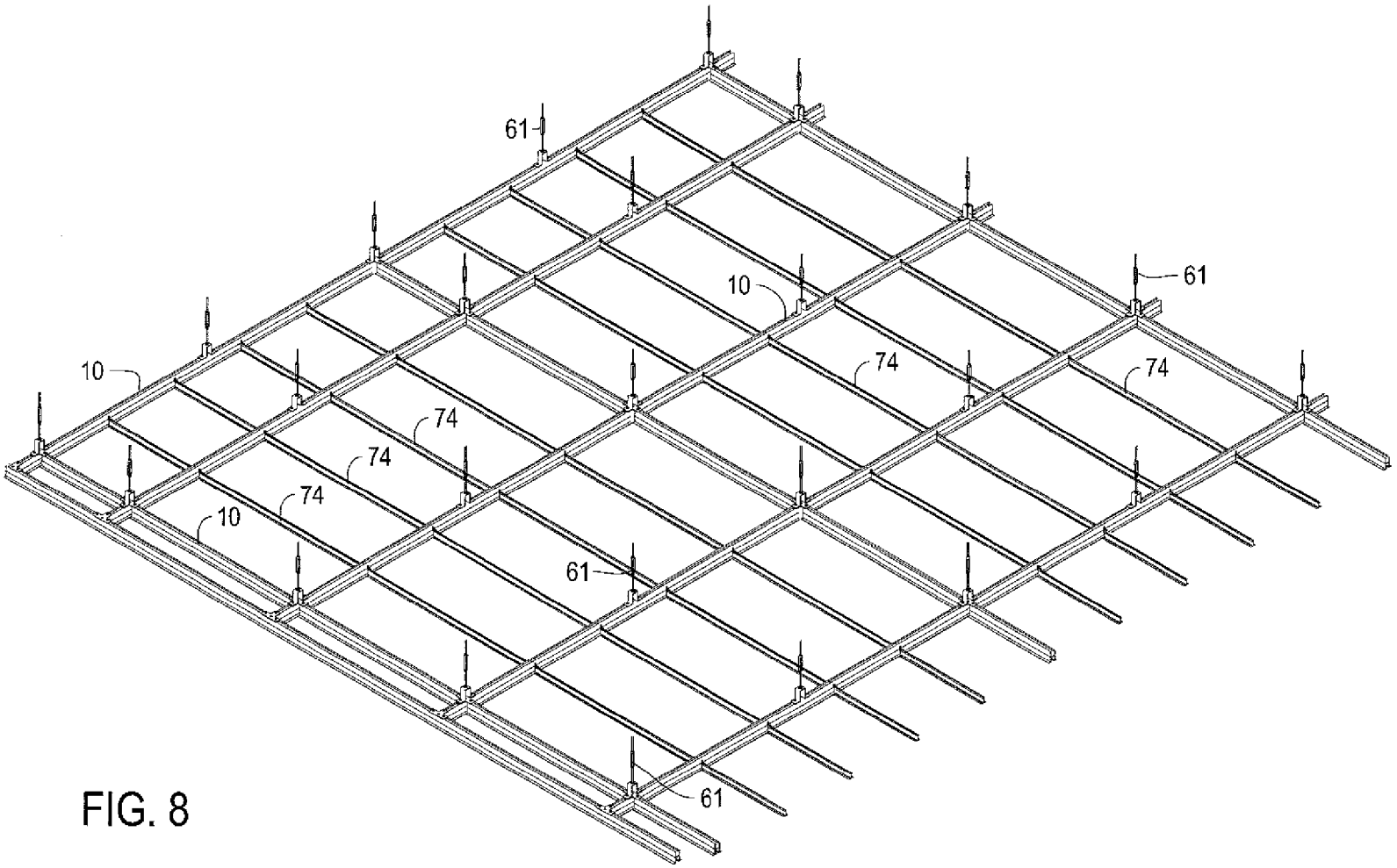
FIG. 8 is a top perspective view of a ceiling grid comprised of a plurality of the elongated structural strut for ceiling grids of FIGS. 1 and 2 and a plurality of the elongated non-structural strut of FIGS. 5 and 6.

As stated, FIG. 8 discloses a partial ceiling grid comprised of a plurality of elongated structural struts 10 and non-structural elongated members 74. The grid is attached to and suspended from a ceiling by a plurality of ceiling rod assemblies 61.

What has been described and illustrated herein are preferred embodiments of the invention with some variations. The terms, descriptions and figures herein are intended to be for illustration only and are not meant as limitations. Those skilled in the art will recognize that many variations are possible within the scope of the invention, as defined by the following claims.

What is claimed is:

1. An elongated structural ceiling grid member having a longitudinal axis, comprising:

an open-ended upper portion formed by a floor and a first set of first and second parallel and spaced sidewalls extending from and substantially perpendicular to the floor, each of the first and second parallel and spaced sidewalls including a lower flat wall section and an upper section that is continuous with the lower flat wall section and extends towards the other of first and second parallel and spaced sidewalls, the open-ended upper portion having a first opening (a) opposite the floor and (b) defined by the upper sections of the first and second parallel and spaced sidewalls;

an open-ended lower portion formed by a ceiling and a second set of third and fourth parallel and spaced sidewalls extending from and substantially perpendicular to the ceiling, each of the third and fourth parallel and spaced sidewalls including an upper flat wall section and a lower section that is continuous with the upper flat wall section and extends towards the other of the third and fourth parallel and spaced sidewalls, the open-ended lower portion having a second opening (a) opposite the ceiling and the first opening and (b) defined by the third and fourth parallel and spaced sidewalls; and first and second flanges;

wherein:

the open-ended upper portion, the open-ended lower portion and the first and second flanges have longitudinal axes that are substantially parallel to the longitudinal axis of the elongated structural ceiling grid member;

the floor and ceiling are integral; and the first flange is attached to the lower section of the third parallel and spaced sidewall and extends substantially perpendicular in the lateral direction to the flat wall section of the third parallel and spaced sidewall and the second flange is attached to the lower section of the fourth parallel and spaced sidewall and extends substantially perpendicular in the lateral direction to the flat wall section of the fourth parallel and spaced sidewall.

2. The elongated structural ceiling grid member of claim 1, wherein the first flange has an inner surface in substantially the same plane as the innermost surface of the third parallel and spaced sidewall, and the second flange has an inner surface in substantially the same plane as the innermost surface of the fourth parallel and spaced sidewall.

3. The elongated structural ceiling grid member of claim 1, wherein the open-ended upper portion and the open-ended lower portion are formed by extrusion from the same stock.

4. The elongated structural ceiling grid member of claim 1, wherein the upper sections of the first and second parallel and spaced sidewalls are hooks having free ends that are located between the lower flat wall sections of the first and second parallel and spaced sidewalls.

5. The elongated structural ceiling grid member of claim 4, wherein the lower sections of the third and fourth parallel and spaced sidewalls are hooks having free ends that are located between the upper flat wall sections of the third and fourth parallel and spaced sidewalls.

6. The elongated structural ceiling grid member of claim 1, wherein the first and second flanges are elongated bars that extend laterally beyond and outside of the upper flat wall portions of the third and fourth parallel and spaced sidewalls.

7. The elongated structural ceiling grid member of claim 6, wherein the lower flat wall portion of the first parallel and spaced sidewall is in substantially the same planes as the upper flat wall portion of the third parallel and spaced sidewall and the lower flat wall portion of the second parallel and spaced sidewall is in substantially the same planes as the upper flat wall portion of the fourth parallel and spaced sidewall.

* * * * *